United States Patent [19]

Wolf et al.

[11] Patent Number: 4,649,685

[45] Date of Patent: Mar. 17, 1987

[54] SPACER

[75] Inventors: Walter Wolf, Heidenheim; Harald Schulz, Kammeltal, both of Fed. Rep. of Germany

[73] Assignee: Josef Gartner & Co., Gundelfingen, Fed. Rep. of Germany

[21] Appl. No.: 616,731

[22] Filed: Jun. 4, 1984

[30] Foreign Application Priority Data

Jun. 6, 1983 [DE] Fed. Rep. of Germany ..... 3320417
Jun. 16, 1983 [DE] Fed. Rep. of Germany ..... 3321878

[51] Int. Cl.[4] ..... E04B 1/62
[52] U.S. Cl. ..... 52/398; 52/790
[58] Field of Search ..... 52/398, 790, 403, 171, 52/716; 428/34; 49/501, 495, 498, 475

[56] References Cited

U.S. PATENT DOCUMENTS

| | | | |
|---|---|---|---|
| 3,079,651 | 3/1963 | Hagmann et al. | 52/790 X |
| 3,280,523 | 10/1966 | Stroud et al. | 52/790 |
| 3,442,059 | 5/1969 | Kessler | 52/403 |
| 3,455,080 | 7/1969 | Meadows | 52/403 |
| 3,759,771 | 9/1973 | Battersby | 428/34 |
| 3,791,910 | 2/1974 | Bowser | 428/34 |
| 4,311,747 | 1/1982 | Kruschwitz | 52/716 |
| 4,464,874 | 8/1984 | Shea, Jr. et al. | 52/398 |
| 4,479,988 | 10/1984 | Dawson | 52/790 |

FOREIGN PATENT DOCUMENTS

| | | | |
|---|---|---|---|
| 2220461 | 11/1973 | Fed. Rep. of Germany | 52/398 |
| 2362890 | 6/1975 | Fed. Rep. of Germany | 52/398 |
| 2531243 | 10/1976 | Fed. Rep. of Germany | 52/788 |
| 2313538 | 12/1976 | France | 52/398 |

*Primary Examiner*—Carl D. Friedman
*Attorney, Agent, or Firm*—Jerome P. Bloom

[57] ABSTRACT

A spacer for use in connecting the edges of panes of insulating glass, panel walls or the like is coextruded in form of a box-like body together with sealing lips and sealing strips. Its body is preferably composed of a polypropylene filled with glass fibre or mineral powder; its sealing lips of an elastomer and its sealing strips, which effect the adhesion and sealing of the panes or panel walls, preferably of a butyl rubber. The surface portion of its body which is exposed in the application thereof is provided with a vapor sealant such as, for example, a PVDC coating or an adhered metal foil to preclude the occurrence of condensation of water between the panes, wall panels or the like which it serves to space.

19 Claims, 2 Drawing Figures

SPACER

BACKGROUND OF THE INVENTION

The invention relates to a spacer for insulating glass, walls of panels or the like having a synthetic body.

Such spacers are used, for example, for connecting the edges of the panes of an insulating glass close to one another. They may likewise be used in order to simultaneously space and interconnect the outer and inner wall of a panel.

The invention is based on the problem to produce a spacer at a favorable price which is of a sufficient heat stable shape and affords a seal against passage of vapor. More generally the invention provides a new and improved spacer device which is more efficient and satisfactory in use and adaptable to a variety of applications. It also provides an improved method of producing such a device.

SUMMARY OF THE INVENTION

According to the present invention the solution of the problem is characterized in that sealing lips and a jointing or sealing material are fixedly attached to the body, in which respect embodiments of the spacer are preferably produced by coextruding the sealing lips and the sealing material together with the body. It is thus possible to produce the spacer in one operation, having the parts necessary for the jointing and for the sealing or for the coherence of the panes or walls of panels, respectively, coextruded. By coextruding, the coherence between the body and the elastic sealing lips and the body and the jointing or sealing material, respectively, will reach the greatest possible value.

In carrying out the process of the invention the sealing lips are made of an elastomer and the sealing material, provided in a strip form, is composed of a butyl rubber or equivalent material having a good adhesiveness to the material of the spacer body as well as to the material of the glass panes or the walls of panels or the like to which it is applied. In this connection the body of the spacer is formed like a box and consists of a rigid plastic, for example, in one preferred form, polypropylene filled with glass fibre or mineral powder.

In order to avoid humidity coming in between the panes or walls of panels or the like which the spacer interconnects, it furthermore will be provided that at least that area of the body of the spacer which remains exposed after its installation is coated or covered and sealed with an inhibitory layer of material which prevents the passage therethrough of vapor. This layer may consist of any vapor sealing plastic or vapor sealing rubber such as a synthetic resin or, particularly, polyvinylidene Chloride (PVDC) or PVC, or hydrochlorinated rubber (Pliofilm), applied by dipping or by a doctor blade or kiss roller. This inhibitory layer may also be one comprising a metal foil made of aluminium or high quality steel and attached in line during extrusion of the spacer body.

BRIEF DESCRIPTION OF THE DRAWING

The invention is explained in the following by means of a preferred embodiment which may be seen with reference to the accompanying drawing, wherein.

As seen in cross section, the spacer 10 is formed like a hollow box 12, while its longitudinal extent will be determined by the nature of its application. Its side faces 14, 16 against which, in mounted condition, the panes of an insulating glasswork or the walls of a panel or the like are abutted, are provided with sealing lips 18, 20 made of an elastomer, such as, for example, an elastic natural or synthetic rubber. These sealing lips are coextruded together with the box 12, and thereby integrated therewith the length thereof.

Figure 1:
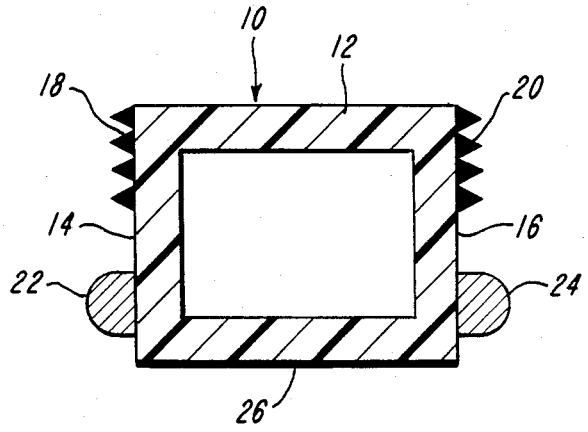
FIG. 1 shows the invention spacer in cross section.

The sealing lips 18 and 20 are preferably incorporated in the upper area of the side faces 14 and 16, considering the orientation of the spacer as illustrated in FIG. 1 of the drawings. However, in practice, this upper area will be that portion of the side faces innermost of the glass panes, panels or the like between which the spacer has been applied.

The illustrated embodiment shows four sealing lips. The number of sealing lips may, however, be larger or smaller.

Considering the spacer in the same orientation as it is shown in FIG. 1, sealing beads 22, 24 are connected to the outer surface of the box 12 of spacer 10 in the lower third of the vertical extent of its side faces 14 and 16. These sealing beads extend lengthwise of the side faces 14 and 16, have a strip form and are made of a permanently elastic plastic, such as, for example, butyl rubber or an equivalent material. Moreover, they are coextruded together with the box 12 and the sealing lips 18 and 20. Thus a firm connection between the sealing strips 22,24 and the body of the spacer is achieved.

The sealing beads 22, 24 being made of a suitable sealing material guarantee the adhesion between and the sealing interconnection of the spacer 10 and the panes, walls or the like between which it applies. The sealing strips are and have to be continuously elastic or plastic in order to accommodate heat expansion under compression stress.

It is known that silicone has heretofore been used as a "sealing" material in the application of various prior art spacer constructions between adjacent panes of insulating glass. However in such use it has been clearly demonstrated that silicone does not prevent passage of vapor to the space between the panes since in many cases condensate in the form of water has appeared between the panes of insulating glass deteriorating the insulating effect thereof and the transparency of the glass work.

The body of the spacer 10, here exhibited as a boxlike construction 12, is made of a rigid plastic, preferably an elastomer because it may be more easily extruded. However, a duromer may also be used, especially for higher performance. The most preferred material for the spacer body is polypropylene filled with glass fibers or mineral fillers, for instance $CaCO_3$, $CaMg(CO_3)_2$, silicates, $BaSO_4$, mica. Polyamides or polyesters which preferably also contain fillers are acceptable.

Viewing FIG. 1, the lowermost surface portion of the body of the spacer 10, there shown, which corresponds to that part thereof which is exposed after installation of the spacer between two panes, walls or the like, is completely covered with an inhibitory layer 26 of a material which is effective to prevent the passage therethrough of vapor. This inhibitory layer 26 may be a synthetic resin and is preferably PVDC, or PVC, in the alternative. A vapor sealing rubber such as hydro-chlorinated rubber (Pliofilm) may be also be employed. In the alternative the layer 26 may be provided by a metal strip, for example aluminium or stainless steel in the form of a metal foil and adhered by a heat sealing composition. When using a metal strip, care must be taken that the sealing strips are applied so that no part of the body of the spacer between the sealing strips 22 and 24 in connection with the side walls 14 and 16 and the strip 26 providing the vapor seal is exposed to air. When the metal foil is employed, it may be applied in line during the extrusion process.

Figure 2:
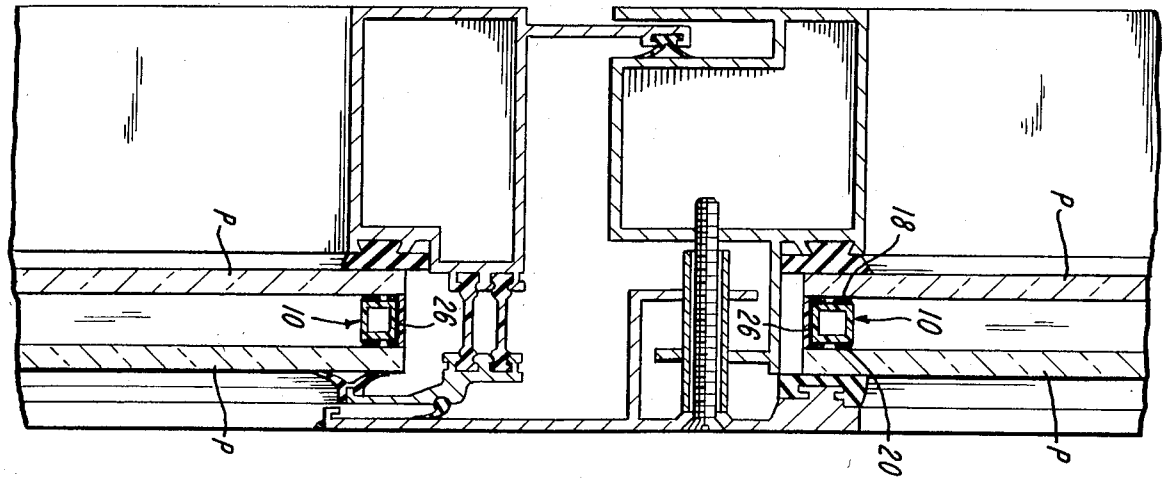
FIG. 2 shows an installation thereof.

In any case, the result of the coextrusion and coherence of the sealing lips 18 and 20 and the sealing strips 22 and 24 with the body of the spacer 10 is a spacer unit which can be very economically produced in a manner to provide it with excellent mechanical qualities and an ability to effect a very good sealing of insulating glass work, panels or the like which must be provided as multipaned or multi-walled structures. It will be understood, of course, that in application of the spacer 10 for such purposes it will be provided in appropriate lengths, ends of which are complementarily configured, to enable them to form a frame between outer edge portions of the facing surfaces of facing panes of insulating glass which bounds the space between the panes which it circumscribes as it is sealing adhered to the panes through the medium of the sealing strips 22, 24. At the same time, the sealing lips 18 and 20 serve also to form a seal between the sides 14 and 16 and the panes to which they abut. Such an application of the spacer 10 is simply demonstrated in FIG. 2 of the drawing which illustrates a brief vertical section of a portion of a building utilizing thermopane windows wherein the panes are separated by spacers in accordance with the present invention.

As heretofore pointed out and described, the spacer of the invention is produced by coextruding the sealing lips 18, 20 and the sealing strips 22 and 24 together with the spacer body 12. In a preferred procedure in forming the total spacer of the invention, an appropriate extrusion die is employed into which the materials of which the parts are formed are fed and in which the materials are extruded separately but simultaneously to form the parts and then interconnected in a coherent integrated fashion to provide the body 12 with the attached sealing lips 18, 20 and the similarly fixedly attached sealing strips 22, 24. Where metal foil is to provide the inhibitory layer 26, this is preferably attached in line during the extrusion of the spacer. Where the layer 26 is provided by a synthetic resin, the surface of the spacer body to be exposed in a use of the spacer is coated with the material of the resin subsequent to extrusion, for example by dipping it into the synthetic resin, the latter of which is provided in a suitable condition for this purpose in a manner well known to those versed in the synthetic resin art. Where the layer 26 is made of a vapor sealing rubber as previously suggested, the rubber will be applied in suitable form in connection with and in line with the extrusion process, as in the case of synthetic resin.

From the foregoing, it may be readily seen that the process of forming the product of the invention is extremely simple and to provide the article of the invention in the form and with the characteristics of those herein described. Thus one not only solves the problem which the invention was intended to solve but also provides a product which is economical and simple to fabricate as well as most efficient and satisfactory in use. Obvious benefits are achieved which are highly important in this particular era in view of the necessity of saving energy in every way possible.

The following must be emphasized in summary. The embodiment of the invention herein illustrated presents a preferred form in composition thereof and should not be construed as limiting. Furthermore, the preferred embodiment illustrated is rectangular in cross section, and with reference to an application thereof, its bottom surface (shown in FIG. 1) is that which faces outwardly with reference to the structures to and between which it may be applied. At the same time, the longitudinally extending strips or beads 22, 24 are of a sealing and good adhesion elastic material cohered to the sides 14, 16 immediately of the lateral extremities of the layer 26 and their nature is such they will be and are compressed in the abutment of the plates or walls to the sides of the spacer by virtue of which to cohere to such plates or walls. The compression also achieves a merging of the beads 22, 24 with the lateral extremities of the layer 26 the length thereof to form therewith a well defined seal precluding passage of vapor from the outer to the inner side of the spacer and into the space between the panes of glass, walls, etc. which the spacer unit bridges. A further characteristic of the preferred embodiment of the invention illustrated is that its sealing lips 18, 20 are triangular in cross section and cohered to the sides 14 and 16 at the portions thereof most adjacent the surface of the body 12 remote from the layer 26. In addition to this these sealing lips to each of the sides 14 and 16 are arranged to form parallel longitudinally extending, closely adjacent, lines which, as will be apparent, are parallel to the line forms of the strips or beads 22, 24. Accordingly, as the panes or walls are applied in abutted relation to the sides 14, 16 the sealing lips are also compressed and interact to provide multiple seals which tightly bridge the sides 14 and 16 and the abutted surfaces of the applied elements. As can be seen, the construction and arrangement of the coextruded parts of the spacer unit of the invention as cohered in the course of their extrusion affords the ultimate in protection to the articles to which the spacer unit is applied.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Apparatus for application and use as a spacer between glass panes, panel walls or like elements, said spacer comprising a unitized structure including a body of non-metallic material, said body having an elongate configuration and the exterior thereof including opposite side surface portions having means integral therewith and projecting outwardly therefrom which provide thereon sealing and jointing means which are arranged in a relatively spaced relation, said sealing and jointing means including one portion thereof formed as sealing lips which extend lengthwise of said body and another portion thereof having the form of beads which run substantially the length of said body in a spaced relation to said lips, the exterior surface of said body being provided, at least in part, with a cohered cover defining a barrier inhibiting the passage therethrough of vapor.

2. Apparatus as in claim 1 wherein said cover is provided by a synthetic resin.

3. Apparatus as in claim 2 wherein said synthetic resin is PVDC.

4. Apparatus as in claim 1 wherein said cover is a metal foil.

5. Apparatus particularly advantageous for application and use as a spacer and to form a seal between adjacent glass panes, panel walls or like elements, said spacer comprising a unitized structure including a body of non-metallic material, said body having an elongate configuration and the exterior thereof including opposite side surface portions having means integral therewith and projecting outwardly therefrom which provide thereon sealing and jointing means which are arranged in a relatively substantially side by side spaced relation, said sealing and jointing means including one portion thereof formed as sealing lips which extend lengthwise of said body and another portion thereof having the form of beads which run substantially the length of said body in coherent relation thereto and, in a spaced relation to said lips which as said spacer is sandwiched between adjacent glass panes, panel walls or like elements simultaneously seal to and form a joint with each thereof.

6. Apparatus as in claim 5 wherein said body is composed of polypropylene filled with glass fiber or mineral fillers.

7. A spacer as in claim 5 characterized in that said lips are substantially triangular in cross section and project substantially perpendicular to the sides of said body to which they apply.

8. A spacer as in clam 5 wherein said lips are substantially triangular in cross section, said lips and said beads are compressible and said beads are of material which will adhesively cohere to such glass panes, panel walls and like elements between which said body is applied in use of said spacer.

9. A spacer as in claim 5 characterized in that said beads have a longitudinally extending strip form and the material thereof has the property of expansion under compression stress when subjected to heat.

10. A spacer as in claim 5 characterized in that said body provides a relatively rigid base for said lips and said beads, said lips are relatively elastic and said beads have a strip form and are substantially permanently elastic and of a character to adhesively cohere to glass panels, panel walls or like elements between which said body is positioned.

11. Apparatus for application and use as a spacer between glass panes, panel walls or like elements, said spacer comprising a unitized structure including a body of non-metallic material, said body having an elongate configuration and the exterior thereof including opposite side surface portions having means integral therewith and projecting outwardly therefrom which provide thereon sealing and jointing means which are arranged in a relatively spaced relation, said sealing and jointing means including one portion thereof formed as sealing lips which extend lengthwise of said body and another portion thereof having the form of beads which run substantially the length of said body in a spaced relation to said lips, said body is a hollow structure which is basically rectangular in cross section, providing it with pairs of said opposite side surface portions, one pair of which has said lips and said beads integral therewith and projecting outwardly therefrom and one of the side surface portions of which the other of said pairs is comprised is covered by means defining a vapor barrier.

12. Apparatus for application and use as a spacer between glass panes, panel walls or like elements, said spacer comprising a unitized structure including a body of non-metallic material, said body having an elongate configuration and the exterior thereof including opposite side surface portions having means integral therewith and projecting outwardly therefrom which provide thereon sealing and jointing means which are arranged in a relatively spaced relation, said sealing and jointing means including one portion thereof formed as sealing lips which extend lengthwise of said body and another portion thereof having the form of beads which run substantially the length of said body in a spaced relation to said lips, said body being a hollow structure and in its totality an extrusion, the configuration of said body providing it with additional opposite surface portions running the length thereof and one of said additional opposite surface portions providing what may be considered the exposed surface portion of said body and the other thereof the innermost outer surface portion of said body in application of said spacer to its intended use.

13. A spacer as in claim 12 wherein said lips are located immediately of one another closely adjacent said one of said additional opposite surface portions of said body and said beads are positioned closely adjacent the other of said additional opposite surface portions of said body.

14. A spacer comprising a unitized extruded structure including a longitudinally extending hollow body of non-metallic material having a cross sectional configuration providing its exterior with a pair of opposite longitudinally extended side surface portions each having means integral therewith and projecting outwardly therefrom which provide thereon elastic sealing and jointing means having the property to adhesively cohere to glass panes, panel walls or like elements abutted thereto, said sealing and jointing means having the form of sealing lips and sealing strips which are arranged to extend substantially the length of said body in a relatively spaced, substantially parallel relation, the form of said exterior of said body providing it with another pair of longitudinally extending side surface portions a first of which faces outwardly and the second of which faces inwardly as the spacer is applied between glass panes, walls or the like in use thereof, said sealing strips being adjacent said first side surface portion of said other pair and said sealing lips being more closely adjacent said second side surface portion of said other pair.

15. A spacer as in claim 14 wherein said first side surface portion of said body is provided with means defining a vapor barrier which together with said sealing strips provides a construction and arrangement precluding passage of vapor.

16. Apparatus for application and use as a spacer between glass panes, panel walls or like elements, said spacer comprising a unitized structure including a body having an elongate configuration and the exterior thereof including opposite side surface portions having means integral therewith and projecting outwardly therefrom which provide thereon sealing and jointing means which are arranged in a relatively spaced relation, said sealing and jointing means including one portion thereof formed as sealing lips which extend lengthwise of said body and another portion thereof having the form of beads which run substantially the length of said body in a spaced relation to said lips, the configuration of said body providing it with additional opposite surface portions running the length thereof and one of said additional opposite surface portions providing what may be considered the exposed surface portion of said body and the other thereof the innermost outer surface portion of said body in application of said spacer to its intended use.

17. Apparatus as in claim 16 wherein said beads comprise an adhesively cohering material and on sandwiching said body between an adjacent pair of glass panes, panel walls or like elements abutted thereto forming both a connection and a vapor seal therebetween.

18. A spacer comprising a unitized extruded structure including a longitudinally extending body having a cross sectional configuration providing its exterior with a pair of opposite longitudinally extended side surface portions each having means integral therewith and projecting outwardly therefrom which provide thereon elastic sealing and jointing means having the property to adhesively cohere to glass panes, panel walls or like elements abutted thereto, said sealing and jointing means having the form of sealing lips and sealing strips which are arranged to extend substantially the length of said body in a relatively spaced, substantially parallel relation, the form of said exterior of said body providing it with another pair of longitudinally extending side surface portions a first of which faces outwardly and the second of which faces inwardly as the spacer is applied between glass panes, walls or the like in use thereof, said sealing strips being relatively adjacent said first side surface portion of said other pair and said sealing lips being more closely adjacent said second side surface portion of said other pair.

19. Apparatus as in claim 18 wherein said sealing strips comprise an adhesively cohering material and on sandwiching said body between an adjacent pair of glass panes, panel walls or like elements abutted thereto forming both a connection and a vapor seal therebetween.

* * * * *